US005983528A

United States Patent [19]

Hartung

[11] Patent Number: 5,983,528

[45] Date of Patent: Nov. 16, 1999

[54] SHOE

[76] Inventor: Peter Hartung, Buchhorn 2, Schanakenbek, Germany, D-21481

[21] Appl. No.: 08/727,428

[22] PCT Filed: Apr. 11, 1995

[86] PCT No.: PCT/DE95/00468

§ 371 Date: Apr. 11, 1997

§ 102(e) Date: Apr. 11, 1997

[87] PCT Pub. No.: WO95/27414

PCT Pub. Date: Oct. 19, 1995

[30] Foreign Application Priority Data

Apr. 11, 1994 [DE] Germany ..... 44 12 154

[51] Int. Cl.[6] ..... A43B 3/24; A43C 13/00

[52] U.S. Cl. ..... 36/15; 36/101

[58] Field of Search ..... 36/15, 100, 101

[56] References Cited

U.S. PATENT DOCUMENTS

| | | | |
|---|---|---|---|
| 2,552,638 | 5/1951 | Melzer | 36/68 |
| 3,972,136 | 8/1976 | Epstein | 36/101 |
| 4,103,440 | 8/1978 | Lawrence | 36/101 |
| 4,333,248 | 6/1982 | Samuels | 36/101 |
| 4,745,693 | 5/1988 | Brown | 36/101 |
| 5,544,430 | 8/1996 | Jacko | 36/100 |

FOREIGN PATENT DOCUMENTS

| | | |
|---|---|---|
| 8716546 | 8/1978 | Germany . |
| 874066 | 5/1960 | United Kingdom . |

*Primary Examiner*—M. D. Patterson

*Attorney, Agent, or Firm*—Jacobson, Price, Holman & Stern, PLLC

[57] ABSTRACT

A shoe has a sole and an upper releasably joined together by a peripheral releasable joining device such as a zipper. The sole has a ridgelike upwardly projecting support member which extends at least partially around the peripheral region of the sole, to form a barrier between the joining device and the interior space of the shoe.

8 Claims, 2 Drawing Sheets

SHOE

BACKGROUND OF THE INVENTION

The invention relates to a shoe, essentially comprised of a sole subassembly and an upper structure subassembly, which sole and upper structure are releasably joined together.

Typically shoes of different colors, appearance, and structure are purchased and worn based on their compatibility with specific items of clothing which the shoe wearer desires to wear. Thus, an assortment of shoes will be acquired by a wearer, not only for leisure and sports applications but also in shoes for everyday wear. It is well known that shoe soles are more costly to manufacture than shoe uppers, for reasons of the materials required and also the manufacturing steps involving machine operations and/or manual operations.

In order to satisfy the desire to wear a variety of shoes of different colors and forms to match frequent changes of clothing, heretofore it has been necessary for a wearer to accumulate a numerically large stock of different shoes. The costs of this stratagem are prohibitive for broad sectors of the population.

A shoe of the general type described initially supra is known (U.S. Pat. No. 4,103,440), in which the sole has a generally trough-shaped (flattened U-shaped) cross section, and the upper structure penetrates into the sole structure to the level of the upper ("inner") surface of the sole proper, or farther. In this known shoe, the said penetratingly extended part of the upper structure tends to transmit movement which is uncomfortable to the wearer. The flexing of the sole when the wearer walks or runs causes buckling and bulging of the material of the upper structure in the natural flexural zones of the shoe. Loci of rubbing develop at the lateral regions of the wearer's foot which are hazardous to a wearer seeking a long duration of wear.

SUMMARY OF THE INVENTION

Accordingly, it is an object of the present invention to provide a shoe of the type described initially supra, which shoe:

allows changing of the shoe configuration and color in a manner which is easy and inexpensive, so that matching with different items of clothing can be achieved;

has a fundamental structure which is not radically different from that of ordinary shoes;

is easy and inexpensive to manufacture;

does not require unusual tools or other means for the wearer to effect the desired changes when changing clothes; and provides wearing comfort which is not inferior to that of ordinary shoes having the upper structure permanently bound to the sole structure.

This object is achieved according to the invention in that the shoe sole has a ridgelike upwardly projecting support member which is fixed to the sole and extends at least partially around the peripheral region of said sole, so that at least the part of the releasable joining device which is connected to the sole is shielded from acting as a barrier the internal space of the shoe by said ridgelike support member acting as a barrier.

The advantage of the inventive solution is essentially that the described support member provides only basic shape stability to the shoe and does not contribute to movements of shoe components adjacent to the side regions of the wearer's foot which regions are highly susceptible to frictional irritation during walking or running. A further advantage is that the described ridgelike support member which extends around the peripheral region of the sole acts to impede lateral penetration of water into the internal space of the shoe, by forming a barrier thereto. Further, the comfort to the wearer of the inventive shoe is essentially the same as with ordinary shoes having the upper structure and sole permanently joined.

The described ridgelike support member is not visible when the sole and upper structure are fastened together, and thus does not affect the overall appearance of the shoe. Therefore it is easy to use different upper structures and soles in desired combinations. The upper structure, which generally determines the impression created by the shoe as to color and form, may be completely removed from a given sole and a different upper structure, having a different color and/or configuration, may be installed. The wearer may keep an entire assortment of such upper structures. According to the invention, these exchanges may be performed without tools or other extrinsic means. A wearer having low manual skill can separate the upper structure from the sole and install a new upper structure, without problems. The ridgelike support member serves to improve the accessibility of the part of the releasable joining device which part is associated with the sole. The invention also makes it possible to readily change soles while retaining a given upper structure; this might be desirable in the case of a change in the weather, so that a special sole for bad weather can be installed in place of a sole for normal weather, and vice versa. Because of the variety of combinations, the total number and weight of shoe units needed for a given set of purposes can be dramatically reduced, whereby, e.g., the weight of a traveler's luggage can be reduced.

According to an advantageous refinement of the shoe, an outer support member is disposed externally of the described ridgelike (inner) support member with the vertical height of the outer support member being less than that of said (inner) support member. The part of the releasable joining device which part is fixed to the sole of the shoe can be readily disposed between the outer support member and the (inner) support member, and can be fixed there by suitable fastening means, e.g. sewing, adhesive bonding, or vulcanization. Said fastening means may involve one or both said support members. In general, any suitable material may be used for the (inner) support member and outer support member, e.g. fabric, leather, or elastic plastic; and said material may in turn be bordered by or enclosed in fabric or leather. Independently of the materials of construction used for said support members, said support members may together have a unit construction, which may facilitate attachment thereof to the sole; further, the sole and said two support members may together have a unit construction.

In order for the inventive arrangement to be optimally dimensioned for the vertical height (vertical thickness) of the foot of the wearer, it is advantageous if the distance between the upper edge of the outer support member and the inner surface of the sole is in the range of 2.6–3.6 cm. It is not imperative according to the invention that the upper structure completely enclose the sole. The upper structure may extend only part of the distance around the peripheral region of the sole; in such a case it is advantageous if the ridgelike support member is provided at least in the front region of the shoe.

In principle, the releasable joint between the sole and the upper structure may be realized in any suitable fashion, provided that the joining device provides a form-interlocking connection between the sole and upper structure when the shoe is being worn.

Advantageously, the releasable joining device comprises a zipper closure or another closure releasable along a linear locus. (Hereinafter, the described closure will be referred to generally as the "zipper".) Said zipper conveniently has:

an upper strip which is connected to the upper structure, and a lower strip which is connected to the sole.

Currently available zippers used in the shoe industry are sufficiently strong and stable to provide a releasable form-interlocking joint between the sole and the upper structure, which joint has a long service life.

When a zipper is employed as the releasable joining device, corrosion problems may occur, e.g. due to moisture, which may render the zipper partially or completely non-functional. In order to avoid such corrosion it is advantageous if at least the interengaging elements (catch elements) of the zipper are comprised of plastic material. Such a zipper is not only less susceptible to the effects of corrosion but is easier to operate and usually is more durable than a zipper in which the interengaging elements are comprised of metal.

According to another advantageous refinement of the inventive shoe, the releasable joining device is comprised of a burr fastener such as a Velcro,™, fastener, wherewith one part of said fastener is connected to the upper structure and the other part is connected to the sole. A shoe with such a joining device is generally adequate for lower-stress applications.

The pulling member in the case of a zipper must be large enough to allow sufficient force to be applied to achieve the closing and opening of the zipper. However, such a large implement can detract from the appearance of the shoe, particularly since said pulling member tends to be pivotally mounted in the slide member of the zipper, allowing it to protrude or to swing back and forth. Thus it is advantageous if a flap device is provided which covers and secures the pulling member of the zipper in the closed state of the zipper, thereby concealing the pulling member from view, preventing the pulling member from swinging randomly outward so as to project from the shoe, and preventing back and forth movement of the pulling member while the shoe is being worn, which movement might be irritating to the wearer and might pose physical risks as well. Advantageously, the flap device is comprised of two flap elements which are releasably held together by means of any suitable fastener (closure means), e.g. a burr fastener, button, snap fastener, or clasp. Preferably, only one flap element is provided.

In order to minimize the disruption of the esthetic appearance of the shoe which the flap device might cause, advantageously the flap device is disposed on the medial side of the shoe exterior, i.e. on the side thereof which faces the second shoe of the pair when the shoes are being worn.

The internal heel region of a shoe is particularly susceptible to causing irritation to the wearer. In order to ensure that the releasable joining device between the sole and the upper structure does not adversely influence the heel of the wearer's foot, i.e. via problematic pressure loci, it is advantageous to provide a rear stiffener (counter) in the heel region of the upper structure, which stiffener is securely attached to the upper structure, wherewith, when the sole and upper structure are joined together, said stiffener projects into the insole region or the like of the sole, said projection being in the nature of a generally horizontally extending strip or flap. In general, the shape and structure of the rear stiffener are similar to those of analogous rear stiffener members found in ordinary shoes.

The invention will be described in more detail hereinbelow, with the aid of an exemplary preferred embodiment and with reference to the accompanying schematic drawings.

DESCRIPTION OF PREFERRED EMBODIMENT

Figure 3:
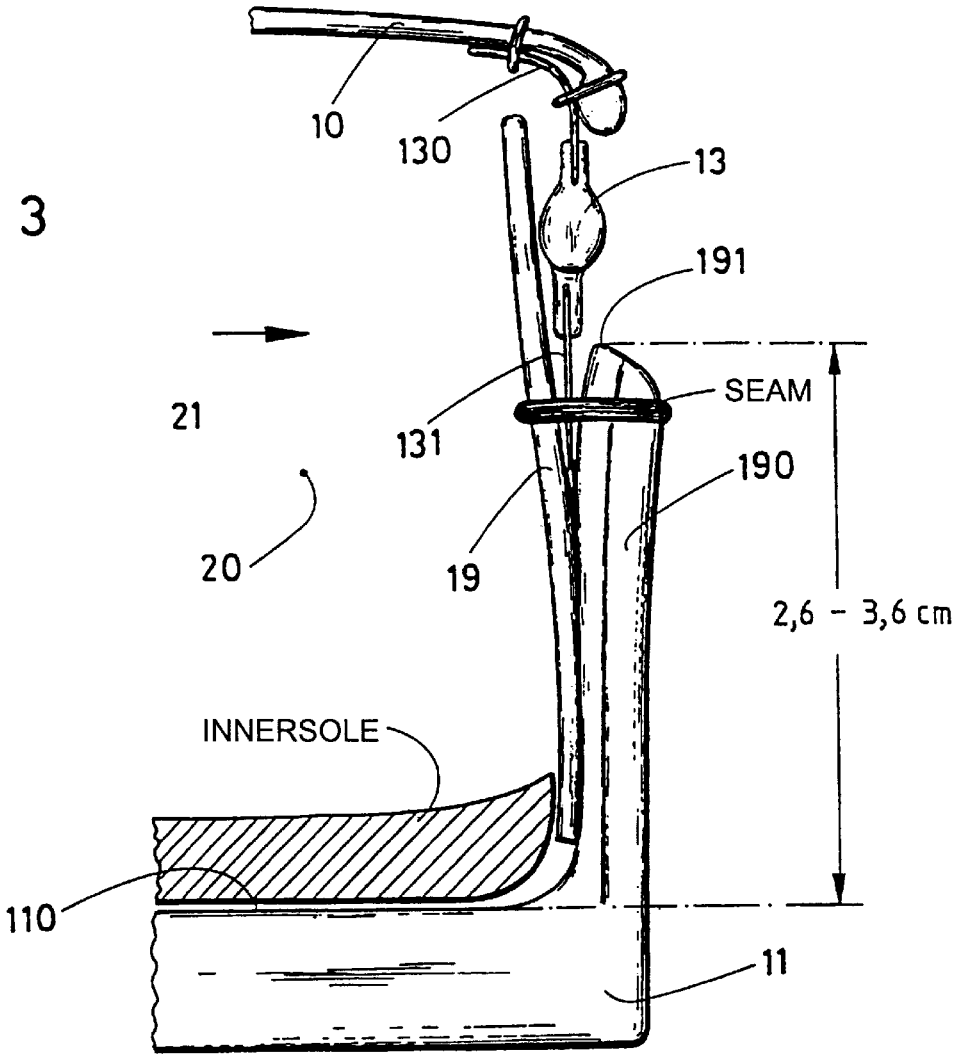
FIG. 3 is an enlarged cross-sectional view of a region of the shoe showing a junction between the sole and upper structure, with said junction provided by a closed zipper.

The shoe 10 illustrated in the drawings is comprised essentially of a sole piece 11 and an upper structure 12. The general structure of such shoes 10 is known; therefore the present description will focus on certain details deemed important for describing the the inventive shoe 10. A releasable zipper 13 is provided which extends generally around the sole 11 and is disposed between the sole 11 and the upper structure 12. The upper strip 130 of which the zipper 13 is comprised is connected to the upper structure 12 by suitable means, e.g. sewing and/or adhesive bonding. The lower strip 131 of which zipper 13 is comprised is connected to the sole 11, also by suitable means, e.g. sewing and/or adhesive bonding (FIG. 3).

The sole 11 has an inner support member 19 in the nature of a strip of material which extends generally peripherally around the sole but interiorly of an outer support member 190 on said sole 11. The inner and outer support members and which may also extend peripherally around the sole (19, 190) may together have a unitary construction, in which case the lower strip 131 on the zipper 13 may be connected to them and located in a slit therebetween in a manner slightly different than described supra, e.g. by sewing. In either instance, when regarded in the direction of arrow 21, (FIG. 3,) the part of the (inner) support member 19 which part is directed into the interior space 20 of the shoe extends appreciably higher than does the outer support member 190, wherewith the interior space 20 of the shoe is protected by the covering effect of inner support member 19 in the region of the zipper 13. Consequently, the shoe wearer will not suffer discomfort or distraction from the zipper 13 while wearing the shoe 10.

As mentioned hereinabove, embodiments of the shoe 10 are conceivable which do not have (or require) an outer support member 190 in addition to the inner support member 19 which member 19 extends generally around the periphery of the shoe. However, in embodiments of the shoe 10 in which an outer support member 190 is present, the distance between the upper edge 191 of the outer support member 190 and the inner surface 110 of the sole 11 is dimensioned to be in the range of 2.6–3.6 cm. As a rule, an innersole 17 (labeled "Einlegesohle" in FIG. 3) is disposed on the inner surface 110 of the sole 11. Said innersole is comprised of a foam or other material. The upper surface of the innersole may have a cover comprised of canvas or the like.

The sole itself may be comprised of any suitable material, such as leather, rubber, or plastic (e.g. polyurethane), or a mixed composite material, or a combination of these.

The inner support member 19 and/or the outer support member 190 may be comprised of leather, fabric, or plastic, or suitable combinations of these, or may have a structure in which one material is bordered by or enclosed in another. The choice of materials may depend on the intended use of the shoe; e.g., casual wear, walking, running, or sports. The (inner) support member 19 and/or the outer support member 190 may be of a unit construction with the sole 11.

The releasable zipper 13 is disposed between the sole 11 and the upper structure 12 in a manner such that the course of the zipper starts and ends at one general location on the exterior of the shoe. If the shoe is regarded as having four sides—front, rear, medial (directed generally toward the medial plane of the wearer's body), and lateral (directed generally away from said plane), the said terminal location of the zipper is conveniently on the medial side of the shoe exterior (FIG. 4), wherewith the starting point of the zipper and the terminus point of the zipper are disposed close together. When the zipper 13 is in the closed state, the pulling member 134 of the zipper can be covered by a flap device 14 having flap elements (140, 141), flap element 140 being the upper flap element, attached to the upper structure 12, and flap element 141 being the lower flap element, attached to the sole 11.

Figure 4:
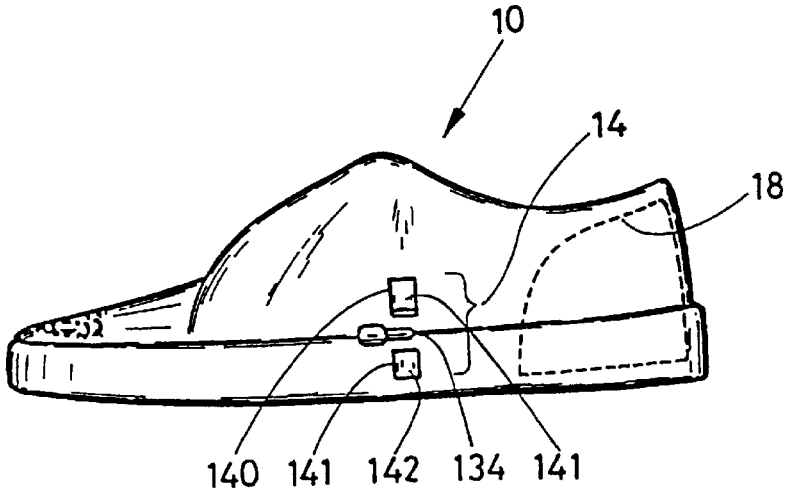
FIG. 4 is a side view of a shoe having side flaps which optionally may be used to cover the pulling member of the zipper, wherewith here said flaps are shown swung into inactive orientations in which said flaps are directed mutually apart.

To cover the puller 134 the upper flap element 140 is swung downward and the lower flap element 141 is swung upward. The flap elements may be held in this closed position by means of a suitable fastener 142, e.g. a clothing fastener such as a burr fastener, button, snap fastener, clasp, or the like. In FIG. 4, the two flap elements (140, 141) are shown in the open position.

Figure 1:
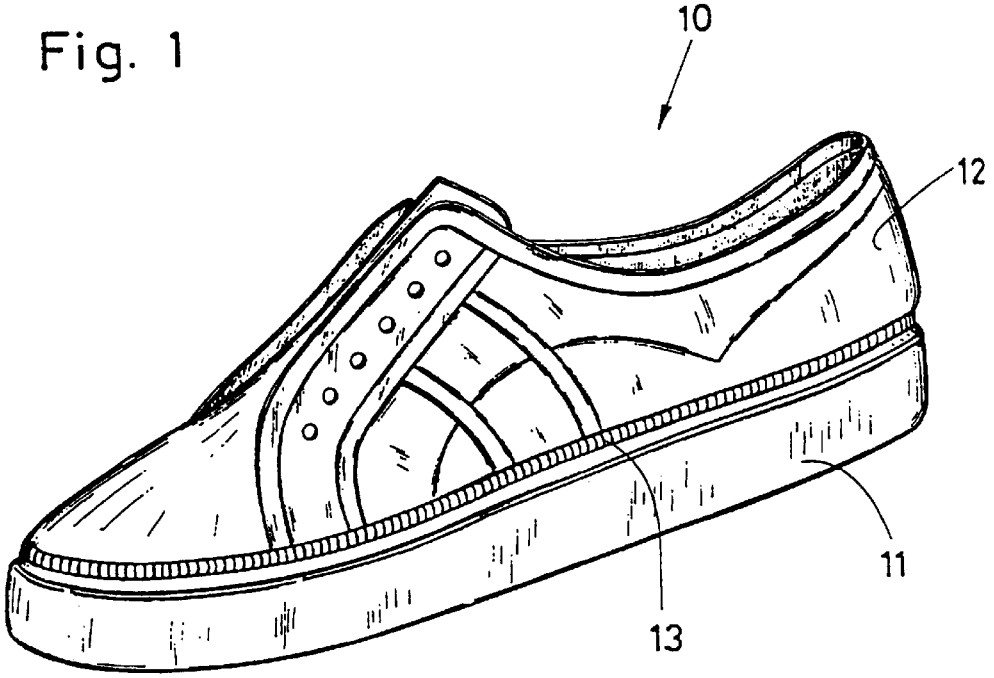
FIG. 1 is a lateral perspective view of a shoe according to the invention wherein the sole and the upper structure are joined together.
Figure 2:
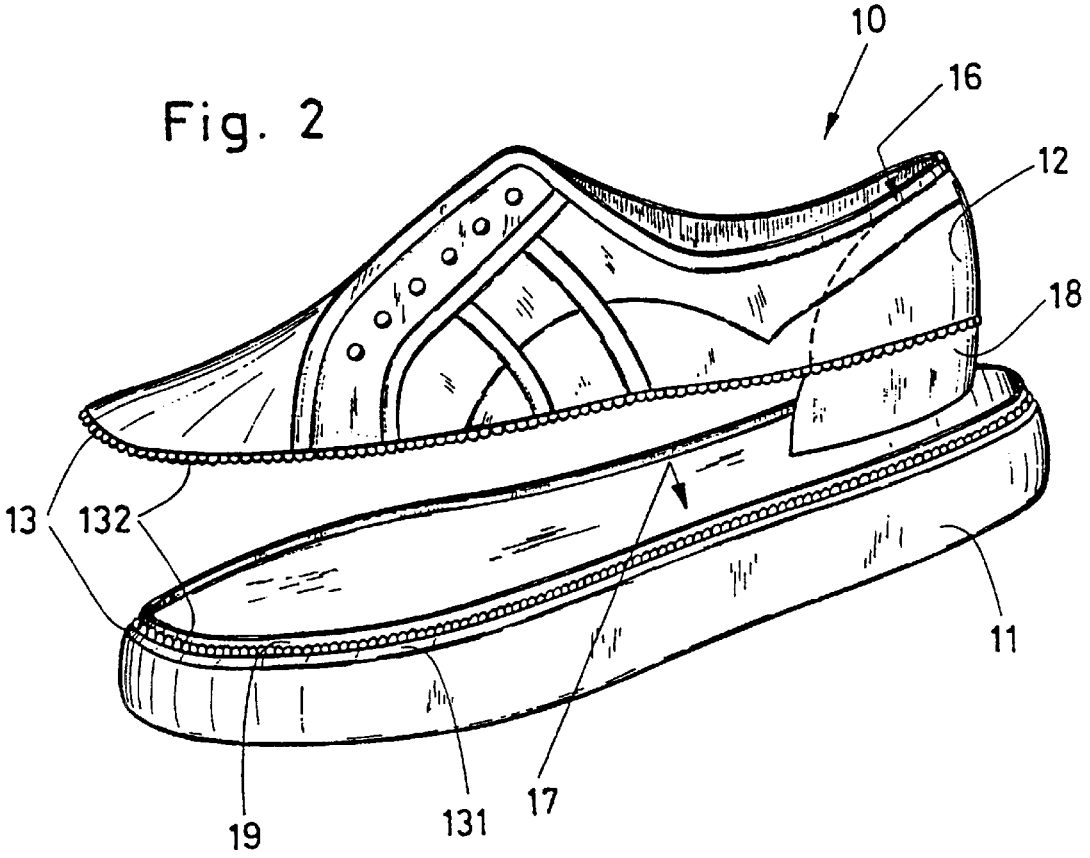
FIG. 2 is a view of the shoe wherein the sole and upper structure have been separated by opening a zipper.

A rear stiffener (counter) 18 may be provided in the heel region 16 of the upper structure 12 (see especially FIG. 2), which stiffener 18 projects into the insole region 17 of the sole 11 when the sole 11 and upper structure 12 are joined together by the zipper 13 (see FIG. 1). The rear stiffener 18 is permanently attached to the upper structure 12 by adhesive bonding and/or sewing and/or vulcanization.

The actual structure of the zipper 13 itself is arbitrary. The material of construction of the zipper 13 (or at least of the interengaging elements 132 of the zipper) may be plastic, which affords the necessary flexibility, is easy to produce in a desired color, and is resistant to moisture and soiling. For certain applications, however, an ordinary zipper 13 with metal catch elements 132 may be preferred.

List of Reference Numerals

10 Shoe
11 Sole of shoe
110 Inner surface [of sole]
12 Upper structure (commonly "upper")
13 Zipper closure ("zipper")
130 [Upper] strip [component of zipper]
131 [Lower] strip [component of zipper]
132 Interengaging elements (catch elements) [of zipper]
134 Pulling member [of zipper]
14 Flap device
140 [Upper] flap element
141 [Lower] flap element
142 Fastener
15 [sic—not shown] Internal region
16 Heel region
17 Innersole [region]
18 Rear stiffener (counter)
19 [(Inner)] support member
190 Outer support member
191 Upper edge [of outer support member 190]
20 Internal space of shoe
21 Arrow

I claim:

1. A shoe comprising a sole member and an upper member, the upper member and the sole member being connected together so as to be detachable by a separable connecting mechanism, said separable connecting mechanism including two parts, the sole member including a vertically extending frame member attached to said sole member and surrounding said sole member, the vertically extending frame member including two parts, one part of said two parts of the separable connecting mechanism being attached to and located between the two parts of said vertically extending frame member, the other part of said two parts of the separable connecting mechanism being attached to the upper member, one part of the two parts of the vertical extending frame member facing an interior of the shoe and extending higher above the sole member than the other part of the two parts of the vertically extending frame member, the other part of the two parts of the vertically extending frame members being unitary with and facing outwardly, away from the sole member, so that the two parts of the separable connecting mechanism are covered and protected from being contacted from the interior of the shoe, and a rear stiffener located in a heel region of the upper member, securely attached to the upper member for projecting into the interior of the sole member interiorly of said one part of the vertical frame member when the sole member and upper member are attached together so as to ensure that the separable connecting mechanism between the sole member the upper member does not adversely influence a heel of the wearer's foot.

2. A shoe according to claim 1, wherein the two parts of the vertically extending frame member have a unitary construction.

3. A shoe according to claim 1, wherein the other part of the two parts of the vertically extending frame member has an upper edge spaced from an inner surface of the sole member by a distance in the range of 2.6–3.6 cm.

4. A shoe according to claim 1, wherein the separable connecting mechanism comprises a zipper having an upper strip, defining the other part of the two parts of the separable connecting mechanism, is connected to the upper member and a lower strip, defining said first part of the two parts of the separable connecting mechanism, is connected to the sole member.

5. A shoe according to claim 4, wherein the zipper has catch elements comprised of plastic material.

6. A shoe according to claim 4, wherein the zipper has a pulling member and the shoe member includes a flap device for covering the pulling member when the zipper is in a closed state.

7. A shoe according to claim 6, wherein the flap device comprises two flap elements and a fastener for holding the flap elements together.

8. A shoe according to claim 6, wherein the flap device is disposed on a medial-side surface region of the shoe.

* * * * *